US008925779B1

(12) United States Patent
Twigg et al.

(10) Patent No.: US 8,925,779 B1
(45) Date of Patent: Jan. 6, 2015

(54) DISPOSABLE OR REUSABLE CONVERTIBLE SHOPPING BAG/BACKPACK

(71) Applicants: Michael J. Twigg, Knoxville, TN (US); William Mark Morse, Knoxville, TN (US)

(72) Inventors: Michael J. Twigg, Knoxville, TN (US); William Mark Morse, Knoxville, TN (US)

(73) Assignee: BagPacks, Inc.

( * ) Notice: Subject to any disclaimer, the term of this patent is extended or adjusted under 35 U.S.C. 154(b) by 0 days.

(21) Appl. No.: 14/194,857

(22) Filed: Mar. 3, 2014

Related U.S. Application Data

(60) Provisional application No. 61/818,072, filed on May 1, 2013.

(51) Int. Cl.
*A45F 3/04* (2006.01)
*A45C 9/00* (2006.01)
*A45F 4/02* (2006.01)

(52) U.S. Cl.
CPC ... *A45C 9/00* (2013.01); *A45F 3/04* (2013.01); *A45F 2004/023* (2013.01)
USPC ..... 224/579

(58) Field of Classification Search
USPC ..... 224/578, 579
See application file for complete search history.

(56) References Cited

U.S. PATENT DOCUMENTS

| | | | | |
|---|---|---|---|---|
| 4,148,431 | A * | 4/1979 | Lepisto | 383/14 |
| 4,273,274 | A | 6/1981 | Freistadt | |
| 4,763,763 | A * | 8/1988 | Sadow | 190/115 |
| 5,570,828 | A | 11/1996 | Lewis | |
| 5,738,263 | A | 4/1998 | Lewis | |
| 5,882,118 | A | 3/1999 | Daniels et al. | |
| 6,068,584 | A | 5/2000 | Daniels et al. | |
| D450,452 | S * | 11/2001 | Vazquez | D3/303 |
| 6,343,729 | B1 | 2/2002 | Platta | |
| D590,150 | S * | 4/2009 | Miller | D3/246 |
| 8,235,206 | B2 * | 8/2012 | Siegel et al. | 206/279 |
| 2006/0153477 | A1 * | 7/2006 | Koguchi | 383/14 |
| 2007/0108247 | A1 | 5/2007 | Bardes | |

* cited by examiner

*Primary Examiner* — Justin Larson
(74) *Attorney, Agent, or Firm* — Robinson IP Law, PLLC

(57) ABSTRACT

A disposable or reusable shopping bag which can be carried by hand or worn on the back of a user as a backpack. The reusable shopping bag provides an inexpensive bag with shoulder straps concealed within the side gussets. The shoulder straps can be deployed in order to wear the bag as a backpack or may remain concealed in the gussets when the bag is functioning as a handheld shopping bag.

21 Claims, 7 Drawing Sheets

DISPOSABLE OR REUSABLE CONVERTIBLE SHOPPING BAG/BACKPACK

CROSS-REFERENCE(S) TO RELATED APPLICATION(S)

This application claims priority to U.S. Application Ser. No. 61/818,072 to Michael J. Twigg and William Mark Morse for a "Disposable or Reusable Convertible Shopping Bag/Backpack" which was filed on May 1, 2013, the content of which is incorporated herein by reference in its entirety.

FIELD

This disclosure relates to the field of bags. More particularly, this disclosure relates to a portable bag configured to convert from a hand-carried bag to a shoulder-carried bag.

BACKGROUND

Gusseted shopping bags are ubiquitous in the United States. They are inexpensive and convenient for carrying goods from store to home. However, they are not particularly comfortable for carrying by hand over long distances, for long periods, or when traveling by bicycle or motorcycle. At a convention or seminar, for example, patrons are often given inexpensive bags to carry around all day to fill with items from various vendors. Having their hands free reduces fatigue and allows them to fully engage in their activities. The same can be said of shopping in a large retail shopping mall. Many situations arise when it is desirable to have one's hands free while carrying a bag. For example, when needing to hold the hands of toddlers while walking through a parking lot, while needing to push a baby stroller, while answering a cell phone call, while responding to a text message, or while needing to safely navigate a bicycle or motorcycle.

An additional drawback to hand-held shopping bags (besides their aforementioned inconvenience in certain applications, their lack of comfort, and their potential safety hazard) is their lack of marketing prowess. Hand held bags typically hang around knee level and do not catch the attention of passerbys in usual situations.

Lewis has attempted to address some of these issues with her two inventions embodied in U.S. Pat. Nos. 5,570,828 and 5,738,263. The earlier patent (U.S. Pat. No. 5,570,828) shows a bag that is convertible from hand held to backpack mode. However, this invention suffers from excessive manufacturing costs due to its multiplicity of components and multiple manufacturing steps needed for assembly. The shoulder straps on this bag also hang loose and are prone to snagging on nearby items when being carried by hand, thus causing the potential to have the entire bag yanked out of hand with its contents being spilled out on the floor. Lewis' later patent (U.S. Pat. No. 5,738,263) is solely a backpack invention and does not lend itself to carrying by hand. It also requires an excessive amount of material to manufacture that does not serve any useful load carrying capacity. As a result this bag design could be considered a "wasteful" use of material and might not be deemed "green" in the environmental sense of the word.

Platta also invented a disposable backpack (U.S. Pat. No. 6,343,729 B1). Platta's bag is solely a backpack invention and is not amenable for hand carrying.

Freistadt has patented a convertible bag/backpack in U.S. Pat. No. 4,273,274. This bag has a nearly catastrophic flaw in that the straps, used for both hand and shoulder use, cross over the opening of the bag. This makes it very difficult, and sometimes impossible (for a large or bulky item), to load the bag with merchandise. Furthermore, if the items inside the bag are large enough to protrude out of the top of the bag then it will render the shoulder strap application useless as the straps will not be able to be extended for shoulder use.

Bardes U.S. Pat. App. Pub. 2007/0108247 A1 shows a more usable (compared to Freistadt) convertible bag/backpack. It utilizes a dual drawstring mechanism to provide two straps which can be used for hand held use or for shoulder use. This product has the disadvantage of being limited to using drawstrings or straps that are too narrow to comfortably carry a heavy load. As a result the straps tend to "cut" into the user's shoulders. Drawstring type bags tend to cost more to manufacture than other promotional bags. Furthermore, when the bags are cinched closed at the top of the bag such that a drawstring of the bag may be pulled out to be used for carrying the bag, any promotional logos on the bag become unreadable.

Daniels envisions a "promotional strip" in U.S. Pat. No. 5,882,118 which can be placed either inside or outside a bag's gusset. Daniels additionally provides a manufacturing method for forming a bag with such a strip in U.S. Pat. No. 6,068,584. This "promotional strip" is purely for advertising purposes and does not provide any load bearing capacity in order to use it as a carrying strap. Daniels also does not envision placing a strip in both sides of the bag for the purpose of carrying such bag as a backpack.

In conclusion, insofar as we are aware, no shopping bag formerly developed combines a low cost of manufacturing for a shopping bag that is comfortable to use, can be carried just as easily on the back as it can be carried by hand, and does not have loosely hanging straps to encumber its use in hand-carrying mode.

SUMMARY

The above and other needs are met by a convertible shopping bag for converting from a hand-carried configuration to a shoulder-carried configuration.

The present invention contemplates a disposable or reusable, convertible, shopping bag/backpack which is inexpensive to manufacture, easy to convert from hand bag to backpack, and comfortable to use in either configuration. The bag can be manufactured using existing manufacturing techniques and it can be stored and dispensed in large quantities.

The bag may be as small and inexpensive as a typical plastic bag dispensed at grocery stores, or as large and heavy-duty as bags for bulkier items often utilized in specialty stores such as might be found in shopping malls (e.g., bicycle shop, shoe store). A low cost version may be given away at retail checkout as is common nowadays in much of the United States. A higher cost "reusable" version made of heavier duty materials and construction, which may appeal to the environmentally conscious consumer, may be sold at retail cost to such consumer.

The present invention offers a distinct marketing advantage to advertisers wishing to have their logo or advertisement displayed in a prominent location. A bag worn on a user's back has its advertising clearly displayed at close to eye level of any passerby. In a crowded shopping mall or trade show this type of advertising would be much preferred over hand held shopping bags with their advertising going unnoticed at knee level.

One embodiment of the present invention contemplates the straps which are positioned inside both side gussets to be affixed to upper and lower portions a plastic bag. The straps may be inserted simultaneously in the manufacturing process as the gussets are formed and then welded in place simultaneously in the manufacturing process as top and bottom weld seams are applied. Alternatively the straps may be inserted into the gussets and secured to the upper and lower portions of the bag later on in the manufacturing process. Depending on the manufacturing process used the straps may be a single flat strip or they may be folded in half lengthwise to form a double layer with the fold of the strap corresponding to the fold of the gusset crease. The straps remain neatly tucked away inside the gussets when carrying the bag by hand. The straps are pulled out from the gussets when the bag is to be worn as a backpack. Optionally a drop or a strip of non-permanent adhesive may be issued during the manufacturing process to assist in keeping the straps secure inside the gussets until needed. A useful feature of these straps is that their width allows for a greater distribution of the load when the bag is worn as a backpack. This avoids the "cutting" into the shoulders of a user utilizing a bag with shoulder straps made from rope, string, or skinny straps.

An alternative embodiment consists of a heavy-duty version of the same design concept as with the plastic bag embodiment described in the previous paragraph. A heavy-duty bag utilizing the same design concept can be manufactured out of thicker plastic film, fabric (woven or nonwoven), canvas, leather, or any other suitable material. In the case of a plastic bag the straps may be heat-welded in place as was done with the lost cost bag. Alternatively the straps may be secured by a different means such as adhesive, sewing, ultrasonic bonding or any other suitable attachment method.

The present invention utilizes a new design which incorporates a convertibility aspect of a single low-cost shopping bag into either a handheld bag or a backpack. The present invention can be very low cost thus making it disposable or recyclable as a single-use bag. However, an alternative embodiment utilizing heavy duty materials with a resultant increase in manufacturing cost is also envisioned. In this embodiment the bag becomes a "reusable" convertible shopping bag/backpack.

In a first aspect, a convertible shopping bag is provided including a bag body including an upper portion, a lower portion and at least a first gusset formed in a first side of the bag body and at least a first shoulder strap secured adjacent to the at least first gusset formed in the first side of the bag body and secured to the bag body at a first end to the upper portion of the bag body and at a second end to the lower portion of the bag body. The at least first shoulder strap is substantially concealed within the at least first gusset of the bag body in a hand-carried configuration, and wherein the at least first shoulder strap is deployable from the first gusset of the bag body in a shoulder-carried configuration.

In one embodiment, the convertible shopping bag further includes a second shoulder strap secured adjacent a second gusset formed in a second side of the bag body and secured to the bag body at a first end adjacent to the upper portion of the bag body and at a second end adjacent to the lower portion of the bag body, wherein the second shoulder strap is substantially concealed within the second gusset of the bag body in a hand-carried configuration and wherein the second shoulder strap is deployable from the second gusset of the bag body in a shoulder-carried configuration.

In another embodiment, the convertible shopping bag further includes a temporary adhesive applied between the first shoulder strap and the first gusset wherein the temporary adhesive removably secures the first shoulder strap to the first gusset.

In yet another embodiment, the temporary adhesive is applied as a strip along a length of the first shoulder strap between the first shoulder strap and the first gusset.

In one embodiment, the convertible bag is formed out of polyethylene.

In another embodiment, the shoulder straps have a thickness that is greater than a thickness of the bag body.

In yet another embodiment, the convertible shopping bag is formed of a reusable material selected from the group consisting of plastics, cloth, fabric, canvas, leather, foil, netting and combinations thereof.

In one embodiment, the convertible shopping bag is formed of non-woven polypropylene, non-woven polyester, and combinations thereof.

In another embodiment, the convertible shopping bag further includes a closure mechanism secured across an opening adjacent to the upper portion of the bag for contents within the bag.

In yet another embodiment, the closure mechanism comprises a pair of tie straps. In another embodiment, the closure mechanism comprises a hook and loop fastener.

In a second aspect, a convertible shopping bag is provided including a bag body including an upper portion, a lower portion and a first gusset formed in a first side of the bag body, a first shoulder strap secured adjacent to the first gusset formed in the first side of the bag body and secured to the bag body at a first end to the upper portion of the bag body and at a second end to the lower portion of the bag body, a second shoulder strap secured adjacent to a second gusset formed in a second side of the bag body and secured to the bag body at a first end adjacent to the upper portion of the bag body and at a second end adjacent to the lower portion of the bag body, wherein the second shoulder strap is substantially concealed within the second gusset of the bag body. the first shoulder strap is substantially concealed within the first gusset of the bag body and the second shoulder strap is concealed within the second gusset of the bag body.

In one embodiment, the convertible shopping bag includes a temporary adhesive applied between the first shoulder strap and the first gusset and between the second shoulder strap and the second gusset, wherein the temporary adhesive removably secures the first and second shoulder straps to the first and second gussets.

In another embodiment, the temporary adhesive comprises a strip of temporary adhesive applied along a length of the first and second shoulder straps between the first and second shoulder straps and the first and second gussets.

In one embodiment, the convertible shopping bag further comprises a mechanical fastener positioned between the first shoulder strap and the first gusset, wherein the mechanical fastener removably secures the first shoulder strap to the gusset. In another embodiment, the mechanical fastener is selected from the group consisting of a hook and loop fastener, buttons, snaps, pins and combinations thereof.

In yet another embodiment, the convertible shopping bag includes a closure mechanism secured across an opening adjacent to the upper portion of the bag for securing contents within the bag.

In a third aspect, a convertible shopping bag is provided including a bag body having an upper portion, a lower portion and a first gusset formed in a first side of the bag body, a first shoulder strap secured adjacent to the first gusset formed in the first side of the bag body and secured to the bag body at a first end to the upper portion of the bag body and at a second end to the lower portion of the bag body, a second shoulder strap secured adjacent to a second gusset formed in a second side of the bag body and secured to the bag body at a first end adjacent the upper portion of the bag body and at a second end adjacent the lower portion of the bag body, wherein the second shoulder strap is substantially concealed within the second gusset of the bag body, and a temporary adhesive applied between the first shoulder strap and the first gusset and between the second shoulder strap and the second gusset. The first shoulder strap is substantially concealed within the first gusset of the bag body and the second shoulder strap is substantially concealed within the second gusset of the bag body, and the temporary adhesive removably secures the first and second shoulder straps to the first and second gussets.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
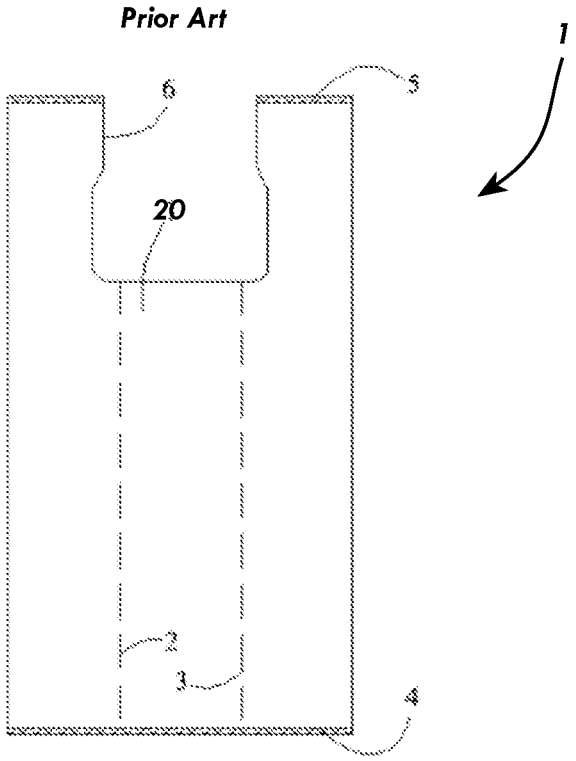
FIG. 1 illustrates a prior art "t-shirt" style shopping bag.
Figure 2:
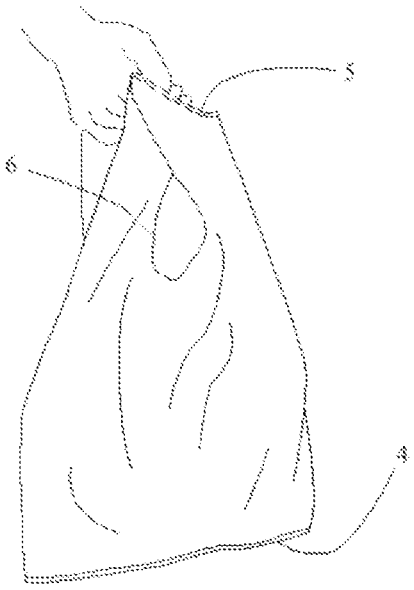
FIG. 2 illustrates a shopping bag loaded with merchandise and being carried by hand according to one embodiment of the present disclosure.

FIG. 1 shows the front view of a typical prior art "t-shirt" style shopping bag 1. Bags of this type are typically manufactured from a continuous roll of polyethylene or other plastic tubing. The bag 1 comprises a bag body 20, the bag body having an upper portion 5 and a lower portion 4. During manufacture of the bag, side gussets 2 and 3 are formed and the bag is pressed flat. Next, localized heat and pressure are applied to seal the upper portion 5 and lower portion 4 of the bag 1. Finally an aperture 6 is cut through the bag which both prepares an opening at the upper portion 5 of the bag and defines one or more handles. The bag 1 may be filled with merchandise and carried in a hand-carrying configuration as shown in FIG. 2.

Figure 3:
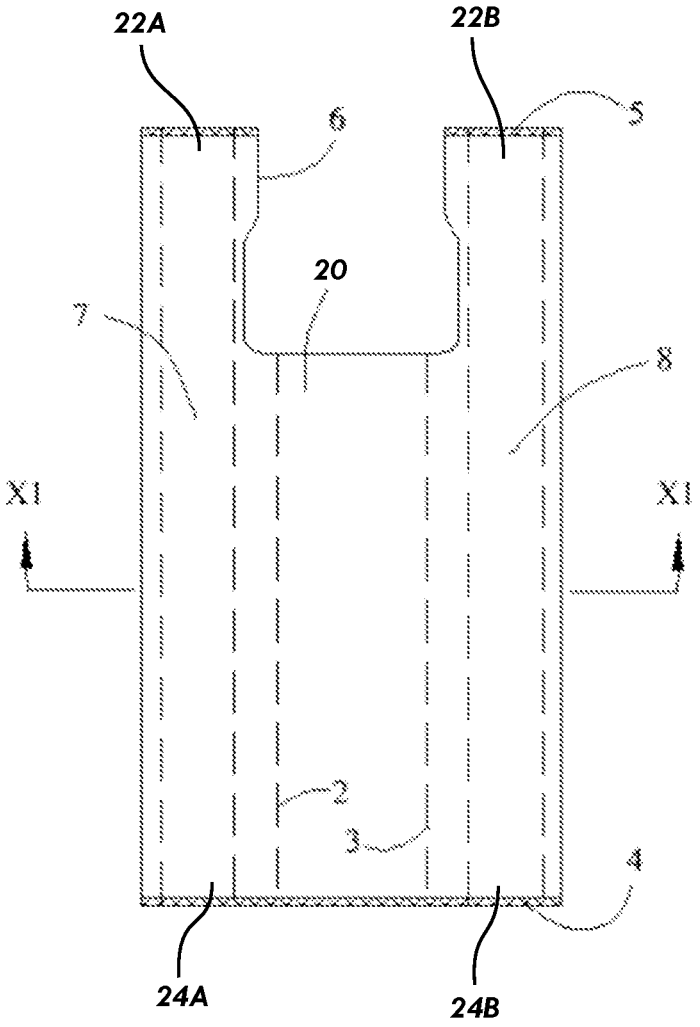
FIG. 3 illustrates a convertible shopping bag according to one embodiment of the present disclosure.

FIG. 3 illustrates a convertible shopping bag including the addition of shoulder straps 7 and 8. The shoulder straps 7 and 8 may be manufactured from the same material as the bag or from a different material. Alternatively, the shoulder straps 7 and 8 may be manufactured from a thicker, stronger material than that of the bag.

Each of the shoulder straps 7 and 8 are secured at a first end 22A and 22B adjacent the upper portion 5 of the bag body 20 and at a second end 24A and 24B adjacent the lower portion 4 of the bag body 20. The shoulder straps 7 and 8 are secured to the bag body 20 adjacent to and inside the side gussets 2 and 3.

While reference is made herein to a pair of shoulder straps 7 and 8, it is also understood that the bag 1 may include only a single shoulder strap or more than two shoulder straps to provide various options for a user desiring to carry the bag 1.

Figure 4:
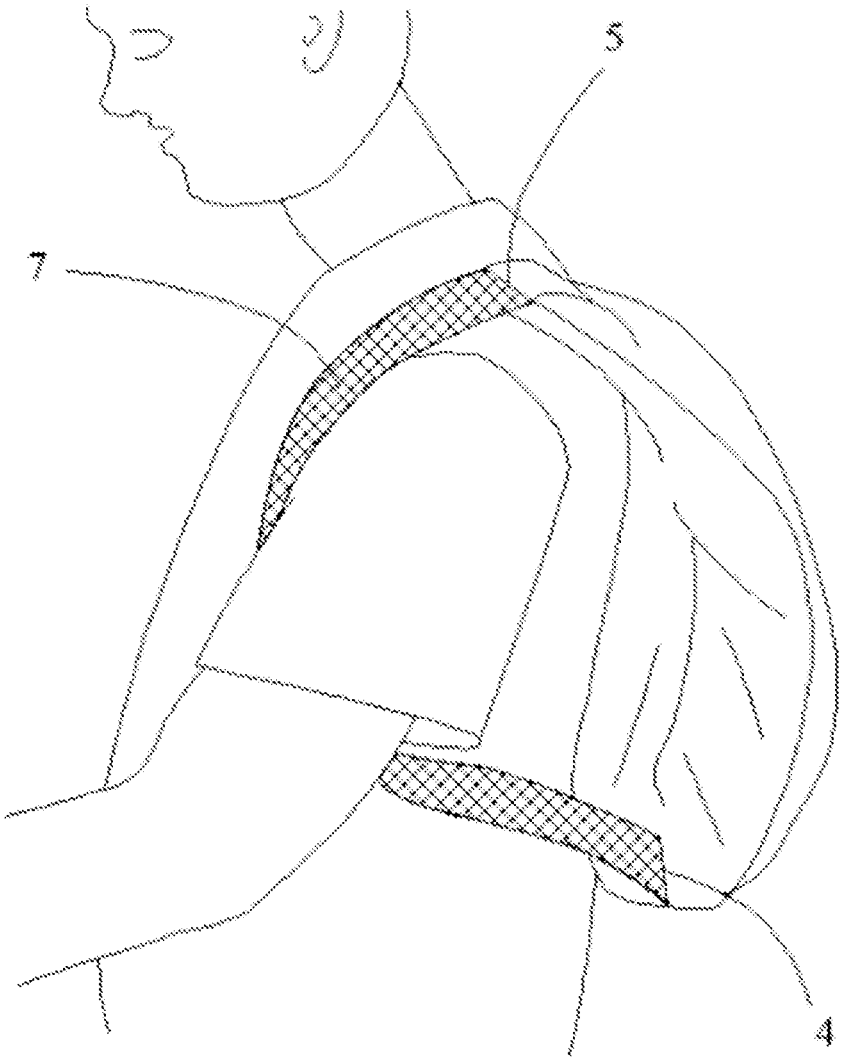
FIG. 4 illustrates a convertible shopping bag worn as a backpack according to one embodiment of the present disclosure.

FIG. 4 shows the bag of FIG. 3 loaded with merchandise and being worn as a backpack in a shoulder-carried configuration. This same bag may also be carried by hand in the hand-carried configuration as shown in FIG. 2.

Figure 5:
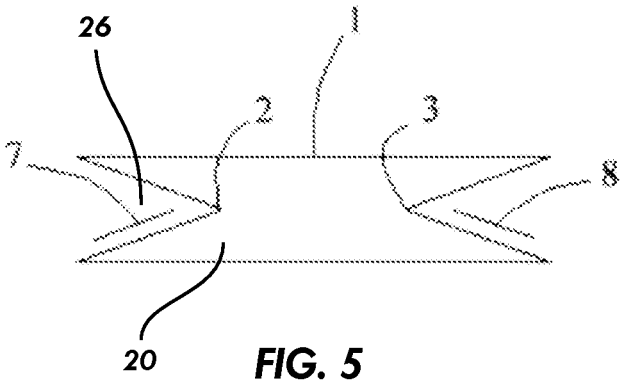
FIG. 5 illustrates a cross-section X1-X1 of the partially expanded bag shown in FIG. 3 according to one embodiment of the present disclosure.

FIG. 5 shows a partially open cross-section X1-X1 of the bag shown in FIG. 3. The bag body 20 is manufactured from a tube of thin plastic film with gussets 2 and 3 pressed into the sides. The gussets 2 and 3 formed into sides of the bag body 1 include a cavity 26 formed as a result of pressing the gussets 2 and 3 into the sides of the bag body 1. The shoulder straps 7 and 8 secured to the bag body 20 adjacent the gussets 2 and 3 are substantially concealed within the gussets 2 and 3 such that the shoulder straps 7 and 8 are positioned within the cavity 26 of the gussets 2 and 3. These straps may be made of the same material as the bag or they may be made of a different material.

Figure 6:
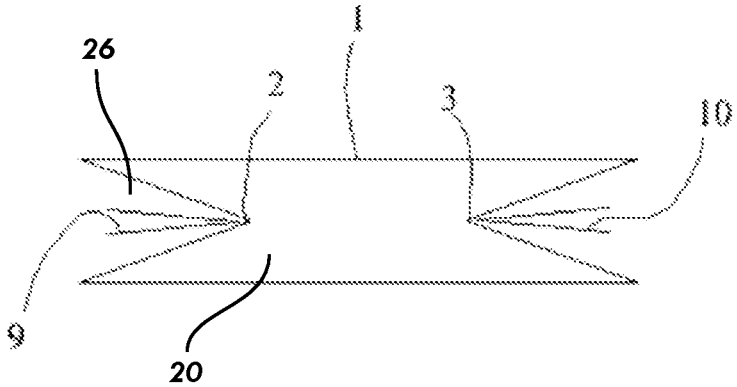
FIG. 6 illustrates an alternative embodiment of the convertible shopping bag according to one embodiment of the present disclosure.

FIG. 6 shows the same bag cross-section of FIG. 5 but with an alternative shoulder strap configuration wherein the shoulder straps 7 and 8 are formed in a V-shape such that the shoulder straps 7 and 8 conform to a shape of the gussets 2 and 3. Since there are different manufacturing methods of applying the side gussets 2 and 3 utilized in industry, other various shoulder strap configurations are envisioned. For example, simple flat straps 7 and 8 may be used such as those illustrated in FIG. 5. In some manufacturing systems this would be the most appropriate and cost effective embodiment of including the shoulder straps. Another manufacturing method would be more amenable to folding and creasing the shoulder straps 9 and 10 at the same time as forming the bag gussets 2 and 3 as illustrated in FIG. 6. A further benefit of utilizing folded shoulder straps 9 and 10 is the additional strength supplied by the straps.

Figure 7C:
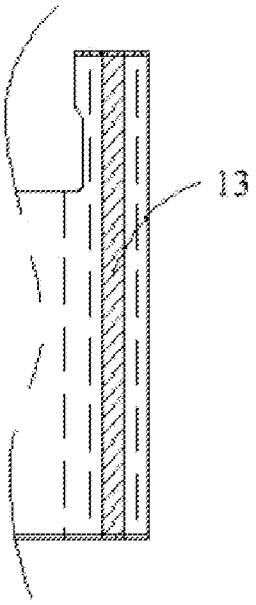
FIGS. 7A-7C show optional adhesive placement locations for securing the shoulder straps inside the gussets until needed according to one embodiment of the present disclosure.
Figure 7B:
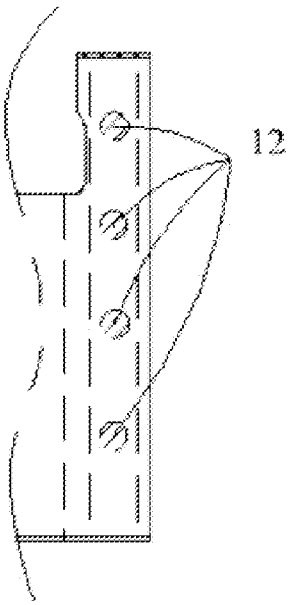
Figure 7A:
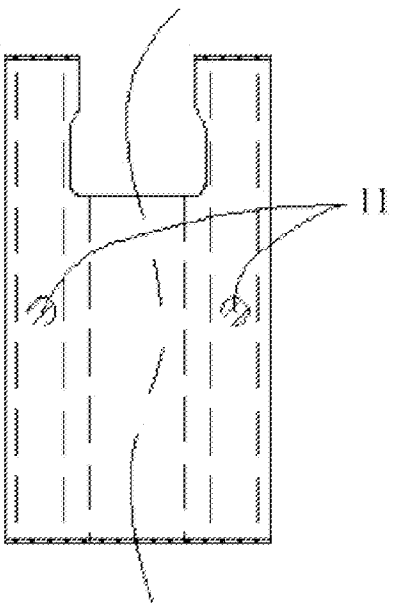

Some bag users may desire to have the shoulder straps more securely affixed inside the gussets than that already naturally provided by aforementioned descriptions of FIGS. 3-6. Therefore it is additionally envisioned that a temporary adhesive may be optionally applied between the shoulder straps 7 and 8 and the gussets 2 and 3 as a manufacturing step. Three adhesive options are illustrated in FIGS. 7A, 7B, and 7C. Temporary adhesive 11 may be applied approximately mid-length of the shoulder strap as shown in FIG. 7A. The adhesive 11 is sandwiched between the outside of the shoulder strap and the inside of the gusset. Alternatively multiple applications of temporary adhesive 12 may be used as shown in FIG. 7B. The temporary adhesive may temporarily secure the shoulder straps not only at mid-length but at additional locations which may be desirable such as inside the handle. Finally, it may be desirable to utilize a continuous strip of temporary adhesive 13 as shown in FIG. 7C. Alternatively, a mechanical fastener may be positioned between the shoulder straps 7 and 8 and the gussets 2 and 3 for removably securing the shoulder straps 7 and 8 within the gussets 2 and 3. Various mechanical fasteners may be used such as hook and loop fasteners, buttons, snaps, pins magnets, and other like fasteners.

The convertible bag 1 may be formed of a disposable material such as plastic or alternatively may be formed of a reusable material such as cloth, fabric, canvas, leather, mesh, laminated or coated materials, or other suitable materials. The reusable material preferably is comprised of non-woven polypropylene, non-woven polyester, or combinations thereof. The straps 7 and 8 may also be manufactured from either disposable or reusable materials such as other plastics, cloth, fabric, canvas, leather, foil, netting, or other suitable strap material. In such embodiments it may be more appropriate to replace heat/pressure weld seams at the upper portion 5 and lower portion 4 of the bag with alternative attachment means such as adhesive bonding, sewing, pins, other welding techniques, ultrasonic bonding, snaps, buttons, hook and loop fasteners, or other suitable attachment methods. It also may be more appropriate in some embodiments to replace the temporary adhesive applications 11 and 12 and the temporary adhesive strip 13 with alternative holding means such as hook and loop fasteners, buttons, snaps, or other releasable mechanisms.

Figure 8A:
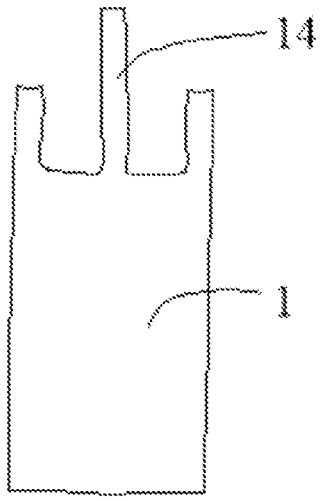
FIGS. 8A and 8B illustrate optional bag ties according to one embodiment of the present disclosure.
Figure 8B:
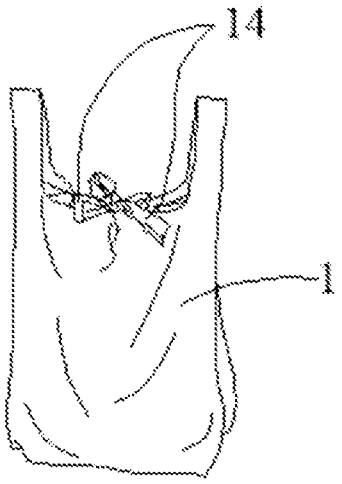
Figure 9:
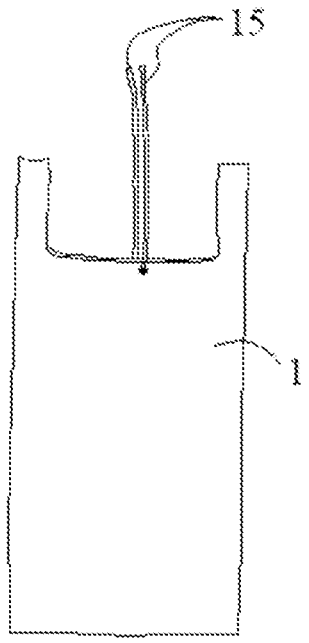
FIG. 9 illustrates alternative optional bag ties according to one embodiment of the present disclosure.
Figure 10:
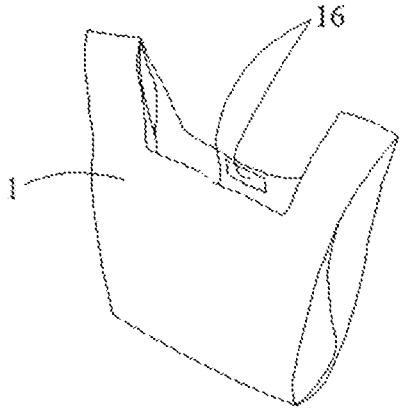
FIG. 10 illustrates a hook and loop closure according to one embodiment of the present disclosure.

In one embodiment a closure mechanism may be used to secure contents within the bag 1. One such closure mechanism is shown in FIG. 8A whereby integrated bag tie straps 14 are included in the bag opening cutout. Once the bag is loaded the tie straps 14 can be secured with a knot as shown in FIG. 8B. Another embodiment of a tie mechanism is a separate independent tie strap, string, or rope 15 that is attached to the bag cutout via sewing, ultrasonic bonding, adhesive or other suitable means such as illustrated in FIG. 9. FIG. 10 shows a hook and loop (e.g., Velcro™) 16 closure mechanism. In place of a hook and loop closure mechanism 16 other options envisioned are buttons, snaps, magnets, zippers, clips, pins or buckles.

Operation

In operation, one can use the bag in the normal manner of a typical shopping bag. The shoulder straps 7 and 8 remain concealed within the bag's gussets 2 and 3 during transportation of the bag and use of the bag in the hand-carried configuration illustrated in FIG. 2 such that the shoulder straps 7 and 8 do not interfere with carrying or transportation of the bag 1. If the user desires to have his hands free for other purposes, or if he desires to more prominently display the bag's advertising, the user may deploy the straps 7 and 8 from the gussets 2 and 3 and thereby wear the bag 1 as a backpack using the shoulder straps 7 and 8 in a shoulder-carried configuration.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A convertible shopping bag comprising:

a bag body including an upper portion, a lower portion and at least a first gusset formed in a first side of the bag body, the first gusset pressed into the first side of the bag body to form a first cavity along the first side of the bag body;

at least a first shoulder strap secured adjacent to the at least first gusset formed in the first side of the bag body and secured to the bag body at a first end to the upper portion of the bag body and at a second end to the lower portion of the bag body;

wherein the at least first shoulder strap is substantially concealed within the first cavity of the first gusset of the bag body in a hand-carried configuration, and wherein the at least first shoulder strap is removable from the first cavity of the first gusset of the bag body in a shoulder-carried configuration.

2. The convertible shopping bag of claim 1 further comprising:

a second shoulder strap secured adjacent a second gusset formed in a second side of the bag body, the second gusset pressed into the second side of the bag body to form a second cavity along the second side of the bag body, the second shoulder strap secured to the bag body at a first end adjacent to the upper portion of the bag body and at a second end adjacent to the lower portion of the bag body, wherein the second shoulder strap is substantially concealed within the second cavity of the second gusset of the bag body in a hand-carried configuration and wherein the second shoulder strap is removable from the second cavity of the second gusset of the bag body in a shoulder-carried configuration.

3. The convertible shopping bag of claim 1 further comprising a temporary adhesive applied between the first shoulder strap and the first gusset wherein the temporary adhesive removably secures the first shoulder strap to the first gusset.

4. The convertible shopping bag of claim 3, wherein the temporary adhesive comprises a strip of temporary adhesive applied along a length of the first shoulder strap between the first shoulder strap and the first gusset.

5. The convertible shopping bag of claim 1, further comprising a mechanical fastener positioned between the first shoulder strap and the first gusset, wherein the mechanical fastener removably secures the first shoulder strap to the gusset.

6. The convertible shopping bag of claim 5, wherein the mechanical fastener is selected from the group consisting of a hook and loop fastener, buttons, snaps, magnets, pins and combinations thereof.

7. The convertible shopping bag of claim 1, wherein the convertible bag is formed out of polyethylene.

8. The convertible shopping bag of claim 1, wherein the shoulder straps are formed from a material that is different than a material of the bag body.

9. The convertible shopping bag of claim 1, wherein the convertible shopping bag is formed of a reusable material selected from the group consisting of plastics, cloth, fabric, canvas, leather, foil, netting and combinations thereof.

10. The convertible shopping bag of claim 1, wherein the convertible shopping bag is formed of non-woven polypropylene, non-woven polyester, and combinations thereof.

11. The convertible shopping bag of claim 1 further comprising a closure mechanism secured across an opening adjacent to the upper portion of the bag for contents within the bag.

12. The convertible shopping bag of claim 11, wherein the closure mechanism comprises a pair of tie straps.

13. The convertible shopping bag of claim 12, wherein the tie straps are integrally formed with the bag body.

14. The convertible shopping bag of claim 12, wherein the tie straps are formed separate from the bag body and thereafter secured to the bag body.

15. The convertible shopping bag of claim 11, wherein the closure mechanism is selected from the group consisting of a hook and loop fastener, buttons, snaps, magnets, pins and combinations thereof.

16. A convertible shopping bag comprising:

a bag body including an upper portion, a lower portion and a first gusset formed in a first side of the bag body, the first gusset pressed into the first side of the bag body to form a first cavity along the first side of the bag body;

a first shoulder strap secured adjacent to the first gusset formed in the first side of the bag body and secured to the bag body at a first end to the upper portion of the bag body and at a second end to the lower portion of the bag body;

a second shoulder strap secured adjacent to a second gusset formed in a second side of the bag body, the second gusset pressed into the second side of the bag body to form a second cavity along the second side of the bag body, the second shoulder strap secured to the bag body at a first end adjacent to the upper portion of the bag body and at a second end adjacent to the lower portion of the bag body;

wherein the first shoulder strap is substantially concealed within the first cavity of the first gusset of the bag body and the second shoulder strap is concealed within the second cavity of the second gusset of the bag body when the convertible shopping bag is in a hand-carried configuration.

17. The convertible shopping bag of claim 16 further comprising a temporary adhesive applied between the first shoulder strap and the first gusset and between the second shoulder strap and the second gusset, wherein the temporary adhesive removably secures the first and second shoulder straps to the first and second gussets.

18. The convertible shopping bag of claim 17, wherein the temporary adhesive comprises a strip of temporary adhesive applied along a length of the first and second shoulder straps between the first and second shoulder straps and the first and second gussets.

19. The convertible shopping bag of claim 16, further comprising a mechanical fastener positioned between the first shoulder strap and the first gusset, wherein the mechanical fastener removably secures the first shoulder strap to the gusset.

20. The convertible shopping bag of claim 16 further comprising a closure mechanism secured across an opening adjacent to the upper portion of the bag for securing contents within the bag.

21. A convertible shopping bag comprising:

a bag body including an upper portion, a lower portion and a first gusset formed in a first side of the bag body, the first gusset pressed into the first side of the bag body to form a first cavity along the first side of the bag body;

a first shoulder strap secured adjacent the first gusset formed in the first side of the bag body and secured to the bag body at a first end to the upper portion of the bag body and at a second end to the lower portion of the bag body;

a second shoulder strap secured adjacent a second gusset formed in a second side of the bag body, the second gusset pressed into the second side of the bag body to form a second cavity along the second side of the bag body and secured to the bag body at a first end adjacent the upper portion of the bag body and at a second end adjacent the lower portion of the bag body, wherein the second shoulder strap is substantially concealed within the second gusset of the bag body; and a temporary adhesive applied between the first shoulder strap and the first gusset and between the second shoulder strap and the second gusset;

wherein the first shoulder strap is substantially concealed within the first cavity of the the first gusset of the bag body and the second shoulder strap is concealed within the second cavity of the second gusset of the bag body when the convertible shopping bag is in a hand-carried configuration; and wherein the temporary adhesive removably secures the first and second shoulder straps to the first and second gussets.

* * * * *